US005099998A

United States Patent [19]

Curzon et al.

[11] Patent Number: 5,099,998

[45] Date of Patent: Mar. 31, 1992

[54] THICK FILM CONTAINER

[75] Inventors: Roy Curzon, Beds, England; Paul T. Harrigan, Jr., Wilmington, Del.; David A. White, Folcroft, Pa.; James J. Magee, Glassboro, N.J.

[73] Assignee: E. I. Du Pont de Nemours and Company, Wilmington, Del.

[21] Appl. No.: 525,362

[22] Filed: May 17, 1990

[51] Int. Cl.[5] ..... B65D 1/10; B65D 77/04; B65D 85/82

[52] U.S. Cl. ..... 206/514; 206/499; 215/1 C; 215/6; 215/10; 215/12.1; 220/258

[58] Field of Search ..... 215/6, 10, 12.1, 13.1, 215/1 C; 220/258, 8; 206/499, 514

[56] References Cited

U.S. PATENT DOCUMENTS

| | | | |
|---|---|---|---|
| 2,072,630 | 3/1937 | Ferry | 215/6 X |
| 2,936,089 | 5/1960 | Goldfarb et al. | 215/6 |
| 2,938,518 | 5/1960 | Horrocks | 215/6 X |
| 3,132.777 | 5/1964 | Hebert | 215/6 X |
| 3,156,279 | 11/1964 | Grebowiec et al. | 215/12.1 |
| 3,311,248 | 3/1967 | Marchant | 215/13.1 |
| 3,841,053 | 10/1974 | Weatherhead, III et al. | 206/499 X |
| 3,933,440 | 1/1976 | Woolley | 215/6 X |
| 4,466,553 | 8/1984 | Zenger | 220/258 X |
| 4,819,819 | 4/1989 | Robertson, Jr. | 220/258 X |
| 4,873,193 | 10/1989 | Jensen et al. | 215/10 X |

FOREIGN PATENT DOCUMENTS

| | | | |
|---|---|---|---|
| 2004647 | 11/1969 | France | 215/12.1 |
| 478240 | 5/1954 | Italy | 215/12.1 |
| 1103222 | 2/1968 | United Kingdom | 215/12.1 |

*Primary Examiner*—Sue A. Weaver

[57] ABSTRACT

A container comprising an inner container, inner lid, outer container and outer lid which is suitable for commercial transport and legible display of required label information, and can be readily grasped and handled such that the lid and contents can be safely and completely removed. The invention further relates to a plurality of such containers, each container having a different maximum capacity but a label area of at least the same size as the label area of the smallest container and the same distance from the bottom of the container such that application of the labels to the containers can be performed by automated means. These containers are useful, in particular, for storing and transporting hazardous materials such as thick film paste materials.

24 Claims, 5 Drawing Sheets

THICK FILM CONTAINER

BACKGROUND

Thick film pastes are compositions comprising inorganic particles, such as metals and metal oxides, dispersed in an organic medium. Among the metals commonly used are lead and cadmium. Solvents such as terpenes, kerosene, dibutylphthalate, butyl carbitol, butyl carbitol acetate, hexylene glycol, high boiling alcohols and alcohol esters are typically included in the organic medium. Finely divided particles of inorganic binder and other additives may also be included. These paste compositions are used to make electrical circuits and devices such as resistors and capacitors.

The packaging and transportation of thick film pastes has been problematic for years. Many thick film pastes are toxic to humans. For this and other reasons, various governmental agencies have imposed labelling requirements on thick film paste containers. However, thick film pastes commonly are sold in quantities as small as one ounce, two ounces and four ounces. The containers for such small quantities are too small to legibly display all the required label information. Including the information as a package insert is unacceptable because the information can be separated from the paste. Packaging the small quantities of paste in containers large enough to legibly display all of the information has been unsatisfactory also. Organic medium tends to evaporate from the paste in the oversized containers and removal of the paste from these containers is difficult.

The toxicity of thick film pastes renders removal of the paste from the container important to the packaging and transportation of the paste. Containers like paint cans and baby food jars have been used for thick film pastes. These containers do no: allow the paste to be removed completely without requiring a special tool to reach all of the paste or requiring a person to put his or her hand dangerously close to the paste.

In addition to considerations regarding toxicity, many thick film pastes are frequently classified as flammable material. To transport these materials commercially, the paste containers must be substantially impermeable with respect to the paste, and capable of withstanding pressure differentials typically experienced during transport, especially transport by air, drops from prescribed heights and having prescribed weights stacked thereon. The glass jars commonly used are fragile and easily broken during transportation. To survive commercial transport intact, glass jars are specially packed in shock absorbent materials. Despite such special packing, the lids on these jars have been known to be dislodged by the pressure differentials experienced during transport by air. The paint can containers which have been used are difficult to grasp and handle, especially when trying to remove the lid, have been dented and crushed during commercial transport and have had the lid dislodged under commercial transport pressure differentials. Conventional polypropylene wide-mouth jars having standard screw thread lids and relatively square corners have also been used as containers for thick film pastes. However, under the pressure differentials experienced during air transport, the polypropylene walls tend to deform and the screw threads on the jar have been known to pull away from the screw threads on the lid, thereby dislodging the lid from the polypropylene jar.

SUMMARY OF THE INVENTION

The invention relates to a container which is suitable for commercial transport and legible display of required label information, and can be readily grasped and handled such that the lid and contents can be safely and completely removed. The invention further relates to a plurality of such containers, each container having a different maximum capacity but a label area of at least the same size as the label area of the smallest container and the same distance from the bottom of the container such that application of the labels to the containers can be performed by automated means.

In one aspect, the invention is directed to a container for a thick film paste composition or component thereof comprising:

(a) an outer container comprising a clarified polymeric jar which includes lid fastening means on the neck of the jar for fastening an outer lid over the mouth of the polymeric jar and retention means in the mouth of the jar for holding an inner container in place within the outer container;

(b) an inner container comprising a polymeric cup which is inert to thick film paste compositions and components thereof, said cup including securing means on the outside wall which cooperate with retention means in the mouth of the outer container to maintain the two containers in a substantially fixed position relative to each other;

(c) an inner lid which is inert to thick film paste compositions and components thereof and which removably friction fits within the mouth of the inner container such that the lip of the inner lid substantially covers the lip of the inner container, the lid including a sealing ring on the lip thereof, and a grasping means to remove the inner lid from the mouth of the inner container without contacting the contents of the inner container; and (d) an outer lid for the outer container, inner container, inner lid assembly comprising jar fastening means which engage the lid fastening means on the neck of the outer container to removably fasten the outer lid, the outer lid when fully fastened to the outer container contacts the inner lid, pressing the sealing ring on the inner lid lip against the lip of the inner container thereby compression sealing the assembly.

In a second aspect, the invention is directed to a system for packaging thick film paste comprising a plurality of the above containers, each container having a label area and a different maximum capacity, the label area on each container being the same distance from the bottom of the container and at least the same size as the label area on the container of smallest maximum capacity.

In a third aspect, the invention is directed to a container comprising:

(a) an outer container comprising a clarified polymeric jar which includes buttress screw threads on the neck of the jar for fastening an outer lid over the mouth of the polymeric jar and a rim along the circumference of and projecting into the mouth of the jar;

(b) an inner container comprising a polymeric cup which is irremovably inserted into the polymeric jar, said cup including a lip and a plurality of locking ribs, both the lip and ribs protruding from the outer surface of the inner container and forming a recess into which the rim of the outer container irremovably fits to maintain the two containers in a substantially fixed position relative to each other;

(c) an inner lid which removably friction fits within the mouth of the inner container such that the lip of the inner lid substantially covers the lip of the inner container, the lid including a sealing ring on the lip thereof, and a grasping means to remove the inner lid from the mouth of the inner container without contacting the contents of the inner container; and (d) an outer lid for the outer container, inner container, inner lid assembly comprising butress screw threads which engage the lid fastening means on the neck of the outer container to removably fasten the outer lid, the outer lid when fully fastened to the outer container contacts the inner lid, pressing the sealing ring on the inner lid lip against the lip of the inner container thereby compression sealing the assembly.

BRIEF DESCRIPTION OF THE DRAWING

The drawing consists of eight figures.

DETAILED DESCRIPTION OF THE INVENTION

Figure 1:
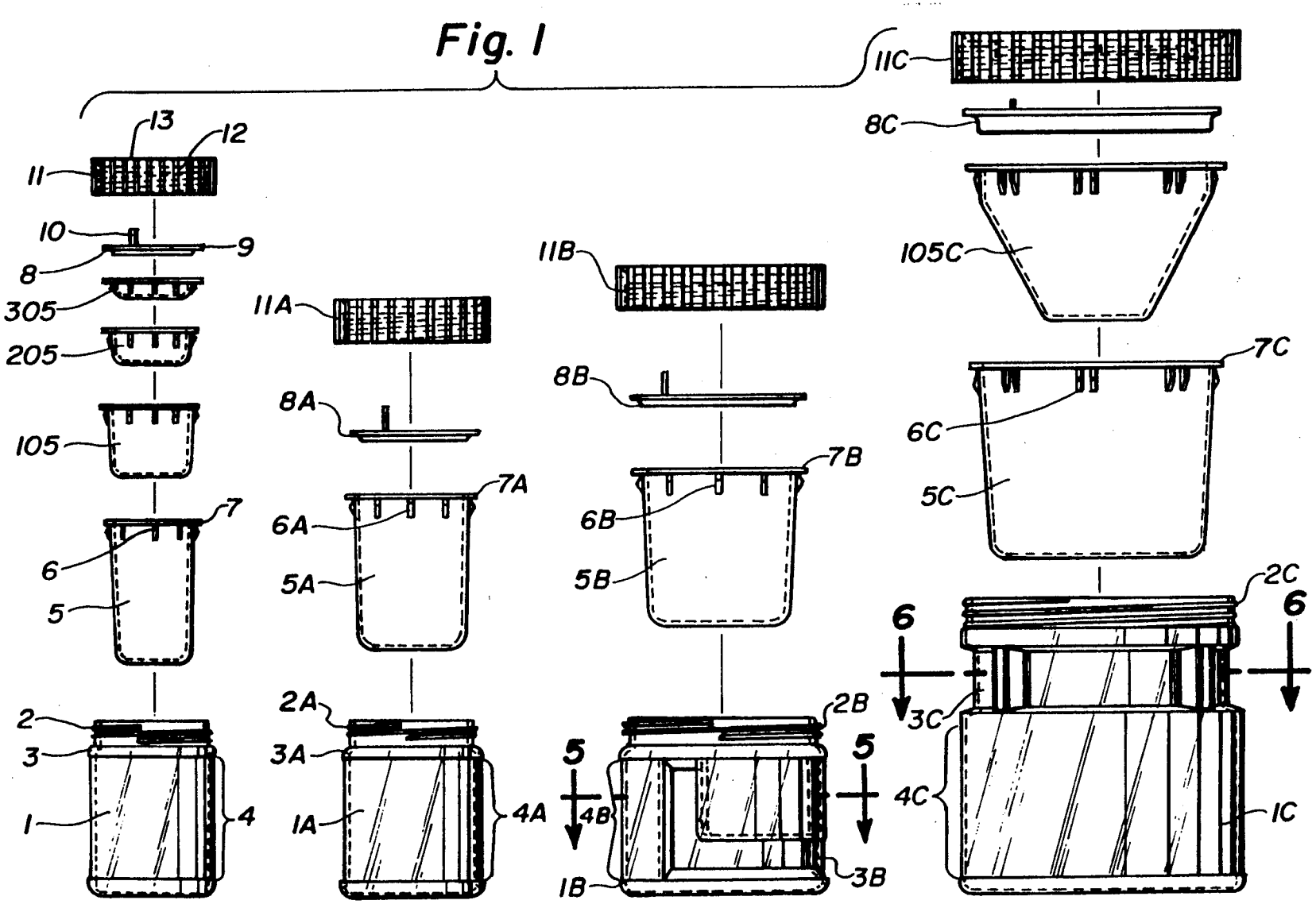
FIG. 1 is an exploded elevational view of a system of containers according to the invention.

FIG. 1 illustrates an embodiment of the present invention comprising a system of containers. This system includes containers of different capacities ranging from, for example, one ounce to one gallon. Any single container in the system comprises an outer container, an inner container, in inner lid and an outer lid.

To assemble a container of FIG. 1, an inner container is snap fit into the corresponding outer container. Each inner container, 5, 105, 205, 305, 5A, 5B, 5C, and 105C comprises a polymeric cup. The inner container holds the thick film paste composition or component thereof. Accordingly, the inner container must be inert to the thick film materials.

Thick film compositions are known in the art and are commercially available. Examples of thick film compositions are disclosed in U.S. Pat. Nos. 4,466,830, 4,514,321, and 4,780,248. Materials suitable for the inert, inner container include polyethylene, polypropylene, surface fluorinated polyethylene, surface fluorinated polypropylene, nylon and fluoropolymers. High density polyethylene and surface fluorinated high density polyethylene are preferred inner container materials.

Figure 2:
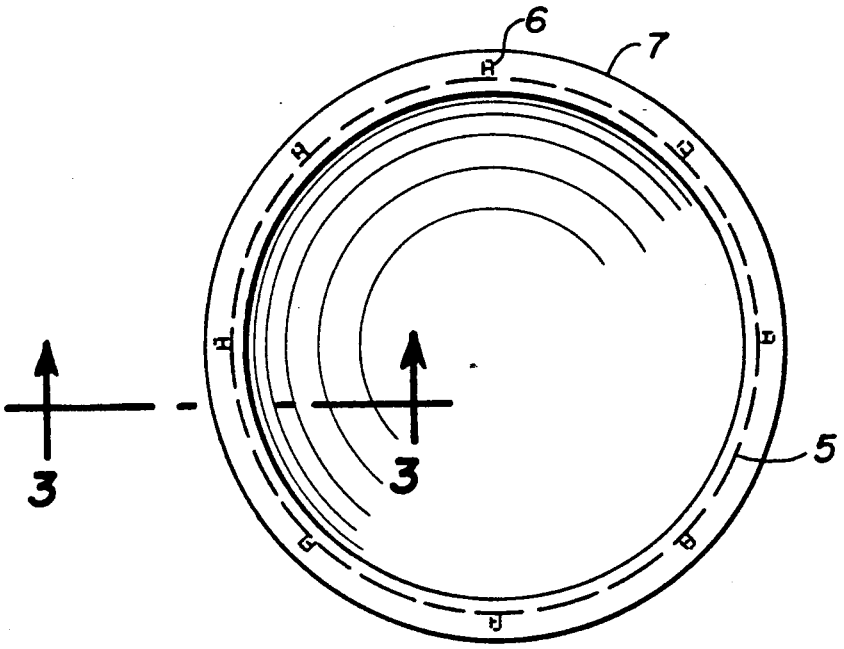
FIG. 2 is a top view of an inner container.

To snap fit the inner container into the corresponding outer container, a securing means on the inner container must engage a retention means of the outer container. Locking rib 6 and lip 7 are an example of a securing means. Rim 15 in FIG. 4 which protrudes into the opening at the mouth of the outer container is an example of a retention means. The number of locking ribs on the outside of the inner container can vary as needed. FIG. 2 shows a preferred embodiment having eight locking ribs.

The locking ribs engage the rim 15 of the outer container in a simple assembly process. In one process, the inner container can be aligned with the mouth of the outer container then pushed bottom first into the outer container until the rim 15 snaps into place in the recess defined by locking rib 6 and lip 7 on the inner container. Alternatively, and preferrably, the inner container is inverted on a flat, stiff surface such that lip 7 rests on the surface. The outer container is inverted also and the mouth of the outer container is aligned directly over the bottom of the inner container. The outer container is then forced down over the inner container until the rim 15 locks into place between rib 6 and lip 7. As the outer container is forced down over the inner container, the rim 15 contacts the ramped section of rib 6. As the force continues to push the outer container, rim 15 of the outer container is expanded elastically until the bottom edge of the rim passes into the recessed section of the rib and locks into place between the rib and the lip.

Figure 3:
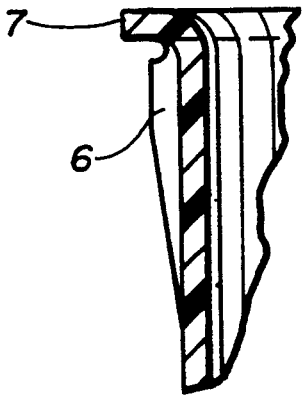
FIG. 3 is a detail sectional view taken on the line 3—3 of FIG. 2 showing a locking rib as the securing means for the inner container.
Figure 4:
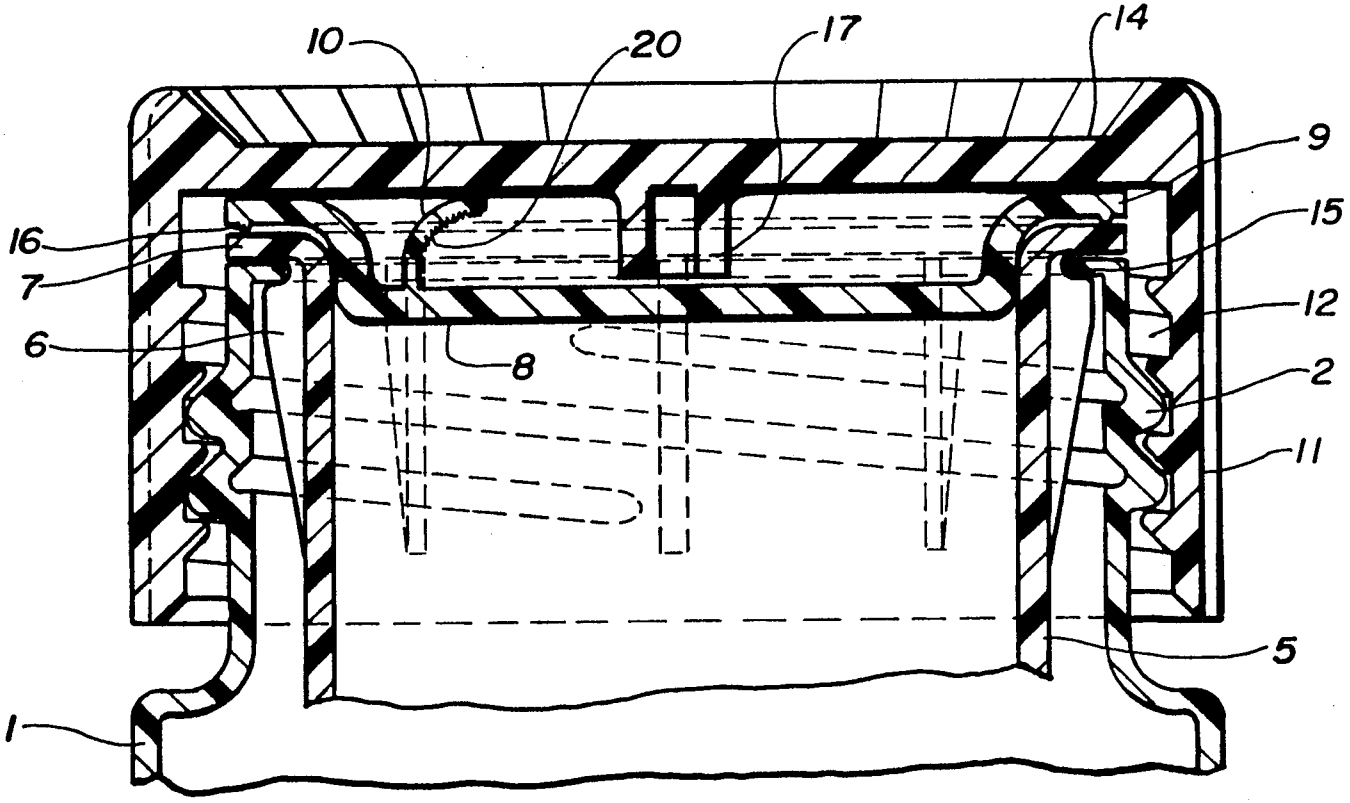
FIG. 4 in a fragmentary vertical sectional view of the top portion of an assembly comprising an outer container, an inner container, an inner lid, and an outer lid.

Once the rib snaps into place, the inner container should be irremovably locked into the outer container. "Irremovably" means that the inner container cannot be separated from the outer container without damaging the inner container, outer container, the securing means on the inner container and/or the retention means in the outer container such that at least one of these features does not function as intended. FIG. 3 shows a securing means for an inner container that comprises a locking rib and lip that irremovably engages an outer container retention means comprising rim 15 (FIG. 4). Lip 7 extends out over the rim of the outer container such that the edge of the lip is virtually flush with the edge of the outer container as shown in FIG. 4. The locking rib surface forms a recess with the inner container lip into which the rim snaps in the assembled position. This recess is bordered by a section of the rib that meets the recess edge at a substantially right angle. Disengagement of the rim from this recess will deform the rim, locking rib, and/or lip of the inner container.

In addition to preventing removal of the inner container, it is also preferred to prevent rotation of the inner container relative to the outer container. Fixing the inner container in place relative to the outer container makes removal of the inner container contents easier and safer. Nonrotation can be accomplished by forming the recess in the locking rib to be substantially the same size and shape as the engaging surface of rim 15. A close fit of the rim in the space defined by the recess of the rib and the lip will require more force to rotate the inner container than is usually encountered in the removal of the paste material.

In order for the inner and outer containers to fit together properly, the rim of the outer container must securely and, preferrably irreversibly, engage the locking rib and lip of the inner container and the inner container must fit within the corresponding outer container. Hence, outer containers of different capacities may accommodate a given inner container. Conversely, inner containers having different capacities may fit properly in a given outer container. The latter situation is illustrated in FIG. 1. Any one of the inner containers 5, 105, 205 or 305 may be inserted into outer container 1. Thus, for example, one ounce, two ounces, four ounces or eight ounces of paste material may be packaged in the same size outer container without experiencing the evaporation problems that typically occur with oversized packages. The size of the smallest outer container is dictated by the label space 4 necessary to legibly display all of the information required by regulation to be displayed.

When inner containers of different capacity are designed for the same size outer container, the effects of the different sizes on factors such as the center of gravity should be considered. For example, it was found that relatively small containers having inner containers of the same basic shape but having different depths such as 5, 105, 205 and 305, were stable and did not tip over. However, the larger container comprising outer container 1C tipped over when inner container 105C was the same shape but half the depth of inner container 5C. Accordingly, inner container 105C was redesigned to lower the center of gravity and avoid tipping of the container.

Each of the outer containers 1, 1A, 1B and 1C comprises a clarified polymeric jar. A clarified polymer outer container permits one to see the inner container and the space between the inner and outer containers without disassembling the container. Visibility of the inner container provides a means for quick confirmation of the inner container size. This is particularly useful when the label is being selected or prepared. Visibility of the space between the inner and outer containers permits inspections, such as customs inspections for undesirable or illegal materials, without disassembling the container. Clarified polypropylene is a preferred clarified polymer.

After the inner container and outer container are fit together, the inner container can be filled with the desired paste material. An inner lid may then be friction fit into the mouth of the inner container. Like the inner container, the inner lid will be in direct contact with the paste material contents of the inner container. Therefore, the materials listed above for the inner container are suitable for the inner lid. And high density polyethylene and surface fluorinated high density polyethylene are particularly preferred materials for the inner lid.

The inner lid friction fits within the mouth of the inner container. To form a tight enclosure, the inner lid of the embodiment shown in the drawings comprises a base, a wall and a lip. When positioned properly in the inner container, the base is relatively flat and parallel to the plane of the container bottom. The outer diameter (O.D.) of the inner lid base is about the same size as the inner diameter (I.D.) of the inner container mouth such that the inner lid wall is in contact with the inner container as shown in FIG. 4. The lip of the inner lid is essentially coextensive with the lip of the inner container. In the position of maximum contact, sealing ring 16 on the inner lid lip 8, 8A, 8B, and 8C contacts the inner container lip as shown in FIG. 4 to form a continuous seal between the inner lid and inner container. This position of maximum contact can be achieved by a number of ways. For example, the inner lid can be friction fit in the inner container by simply pushing the inner lid, base first, into the mouth of the inner container until the interference between the sealing ring 16 on the inner lid and the lip of the inner container prevents further progress of the inner lid (i.e. the maximum contact position is reached). Alternatively, the inner lid can be friction fit into the mouth of the inner container to a point short of maximum contact. As the outer lid is fully fastened to the outer container, the outer lid will push against the inner lid forcing the inner lid into maximum contact with the inner container.

A jar fastening means is provided on the outer lid which cooperates with a lid fastening means on the outer container to removably secure the outer lid to the outer container. Preferably, the lid fastening means is a screw thread located on the neck of the outer container and the jar fastening means is a screw thread on the inner wall of the outer lid. In FIGS. 1 and 4, screw threads 2 and 12 are the lid fastening and jar fastening means on outer container 1 and outer lid 11, respectively. As outer lid 11 is fastened onto outer container 1, that is, as the screw thread on the outer lid 11 and outer container 1 gradually engage each other, the top of the outer lid approaches the inner lid. When outer lid 11 is fully fastened to outer container 1, the top of the outer lid is in contact with inner lid 9, pressing sealing ring 16 against the lip of inner container 5 thereby compression sealing the inner lid-inner container subassembly.

Various national and international rules and regulations pertain to the packaging of hazardous materials, such as thick film paste. A significant amount of information about the materials must be included with each container. The containers of the invention are designed such that each outer container has a label area large enough to accommodate a label that legibly displays all necessary content information and warnings. For example, in FIG. 1, each of the outer containers 1, 1A, 1B, and 1C has a different maximum capacity. Each container has a label area, 4, 4A, 4B and 4C, respectively. The label area 4 of the smallest outer container 1 is large enough to accommodate a label that legibly displays all information required by health, safety and transportation regulations for thick film paste materials.

Each of the label areas 4A, 4B and 4C on the larger containers is at least the same size as the label area 4 on the smallest outer container. Preferably, the label area on all of the outer containers is at least the same height as the label area on the smallest outer container. This feature permits the use of the same size label on all of the containers. If the label information is printed on the label at the point of or just prior to application of the label, a standard blank label may be used for every outer container in the system regardless of size. This reduces the number of labels that must be kept available at the point of application and in inventory. More preferably, the bottom of each label area is the same distance from the bottom of the outer container. This additional feature enables a simplified automated labelling system for the application of the labels to the outer containers. Fewer, if any, adjustments are necessary in the application process for differently sized outer containers. For example, if labelling apparatus is set to affix a label on outer container 1, the same settings for location and label size can be used to affix a label to area 4C on the larger outer container 1C.

The assembled container is suitable for storage and transportation of hazardous materials, particularly thick film paste materials. The inner container and inner lid are inert to and substantially impermeable to the thick film materials. The inner container has a relatively wide mouth and smooth surfaces to permit safe and complete removal of the contents. The outer container and outer lid are strong enough to withstand the rigors of commercial transport without damaging the integrity of the contents or the inner container-inner lid subassembly. And, the entire assembly is substantially impermeable to the thick film material contents and is suitable for commercial transport by air. Substantially impermeable means the filled container loses less than two percent (2%) by weight when stored at 122° F. (50° C.) for 28 days. Suitable for commercial transport by air means the container is able to withstand the pressure differentials encountered in the unpressurized cargo areas of airplanes. To test this, a pressure needle is inserted through the outer container into the inner container. Any opennings around the needle are sealed. Air is pumped into the inner container. If 14.7 psi of air are pumped into the container assembly and the assembly remains intact, the container passes the test and is suitable for commercial transport by air.

Failure to withstand air transport pressure differentials has been a major problem of prior art thick film paste containers. To assure survival of the pressure differentials, some special features can be included in the container.

Buttress threads can be employed as the fastening means on the outer container and outer lid. This type of screw thread is particularly effective in preventing the outer container threads from peeling away from the outer lid threads as the pressure increases.

Pressure ring 17 can be included also. This ring protrudes from the central section of the outer lid top toward the inner lid. In an assembled container, the ring comes close to, but does not touch, the inner lid, as illustrated in FIG. 4. The pressure ring allows the central portion of the inner lid to bow slightly in response to increased pressure. However, the extent of the inner lid bowing is restricted to the distance between the inner lid and the pressure ring under normal pressure conditions. Although the central portion of the inner lid is only permitted to bow slightly, this feature allows the central portion of the inner lid to distort preferentially to the wall and lip in response to increased pressure, thereby preserving the inner container-inner lid seal.

In addition to providing a container that is easy to assemble, and meets labelling and transportation criteria, the container of the invention is designed for safe and easy handling, opening, closing, removal of contents and storage. For example, in a preferred embodiment, the outer diameter of the outer container and outer lid are substantially the same. Such dimensions permit the container to be placed directly onto a roll mill or other similar mixing apparatus. Thus, the contents of the container can be mixed before the container is openned.

To open the container, the outer lid is removed, then the inner lid is removed. To remove the outer lid, the outer container is held in a relatively fixed position and the outer lid is rotated. Typically, this is done manually which means one hand holds the outer container relatively still and the other hand turns the outer lid. If the O.D. of the outer container is about 3–7 inches or less, the average worker can usually wrap his or her hand around the outer container and grasp the outer container with sufficient force to resist rotation during removal of the outer lid. Outer containers 1 and 1A represent containers having an O.D. in this range. Textured sections 3 and 3A on these outer containers are roughened surfaces which reduce slippage and enable a firmer grasp of the outer container than a smooth surface would.

Figure 5:
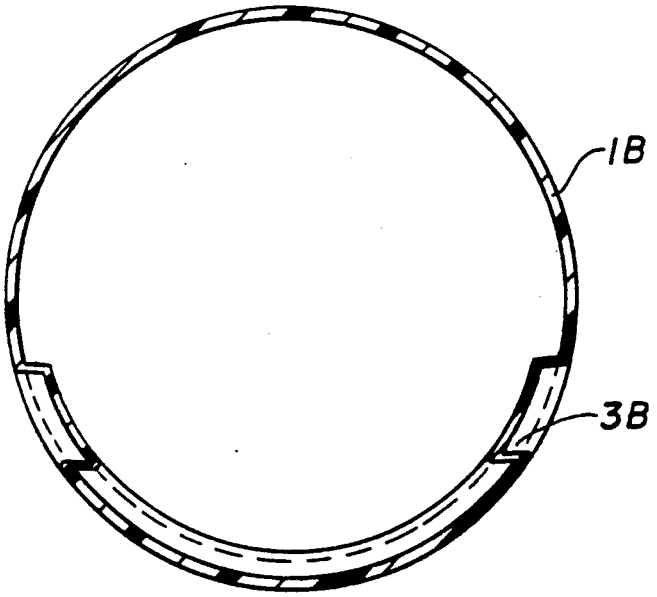
FIG. 5 is an enlarged horizontal sectional view taken on the line 5—5 of the third outer container in FIG. 1.
Figure 6:
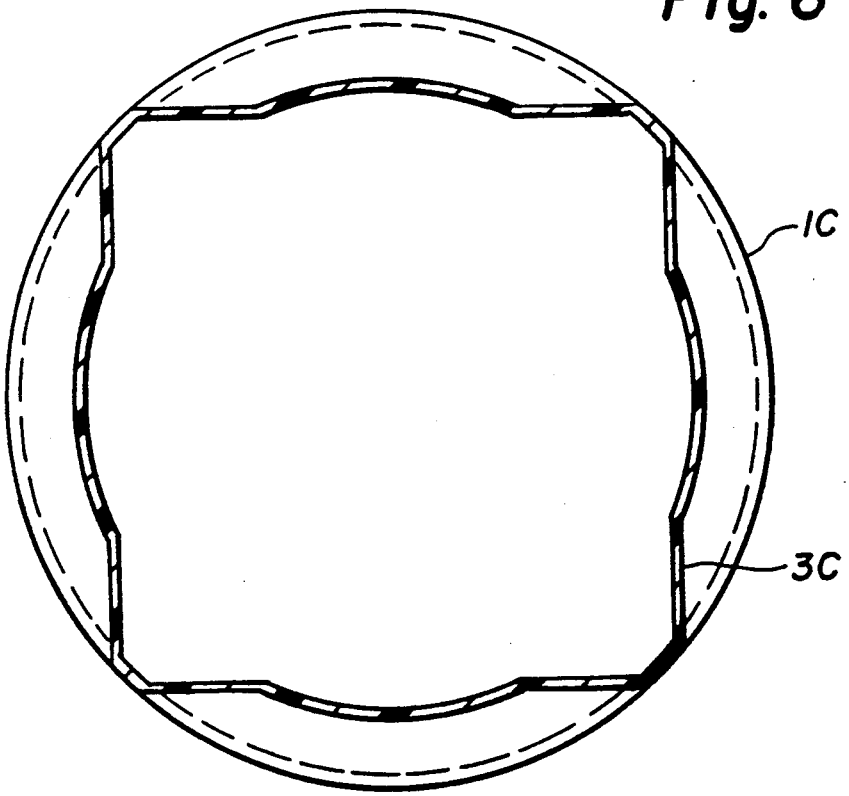
FIG. 6 is an enlarged horizontal sectional view taken on the line 6—6 of the fourth outer container in FIG. 1.

As the outer diameter of the container increases above the 4–5 inch range, it becomes more difficult for the average worker to gain a firm one-handed grasp of the outer container. Two alternative means for enhancing the grasp of larger containers are shown in FIGS. 1, 5 and 6. Outer container 1B has a U-shaped indentation 3B formed into its side. Moving from the outer surface towards the center of the container, the interior walls of the parallel legs of the U are angled towards each other as shown in FIG. 5. Angling these walls in this way enables one to bend his or her fingers into the indentation and firmly grasp the angled walls. Outer container 1C has a section of reduced outer diameter and lugs 3C which protrude from the reduced diameter section. At least two lugs spaced about 2–5 inches apart are included so that the average worker can bend his or her fingers around both lugs and firmly grasp the walls of the lugs. FIG. 6 shows a preferred embodiment in which the lugs are equidistant around the circumference of the reduced section and the outer diameter of the lugs is about the same as the outer diameter of the rest of the container.

Removal and re-fastening of the outer lid can be further facilitated by providing a grasping means on the outer lid. Outer lids having an O.D. of about 3–7 inches or less, can usually be gripped firmly enough by one hand to rotate the outer lid. Outer lids 11, 11A and 11B represent outer lids having an O.D. in this range. Texturing in the form of grooves 13 on these outer lids reduce slippage and enable a firmer grasp of the outer container than a flat surface would.

Figure 7:
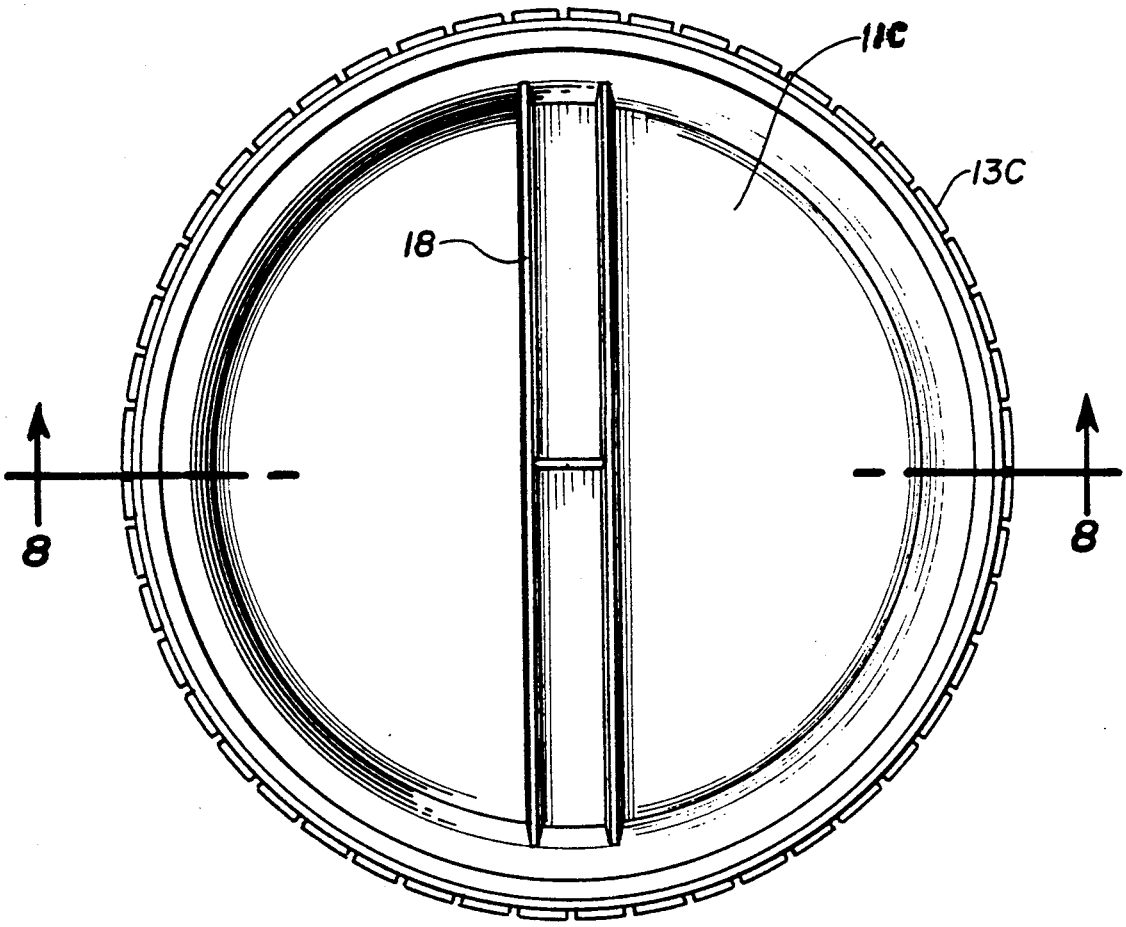
FIG. 7 is a top plan view of an outer lid for a large outer container such as the fourth outer container in FIG. 1.
Figure 8:
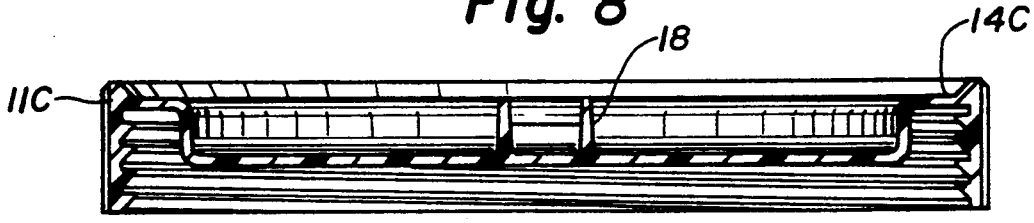
FIG. 8 is a sectional view taken on the line 8—8 of the lid in FIG. 7.

As the outer diameter of the outer lid increases, it becomes more difficult for the average worker to gain a firm one-handed grip on the outer lid. A handle may be included on larger outer lids to facilitate a firm grip. FIGS. 7 and 8 illustrate a handle 18 on a larger outer lid 11C. The handle should protrude far enough from the outer lid surface and be wide enough for one to gain sufficient leverage to turn the outer lid. The preferred embodiment shown in FIGS. 7 and 8 comprises two stiff bars which span across the inner lid top and are spaced apart at a distance such that the average worker can gain a firm grip by bending his or her fingers around both. As a further enhancement, a lever can be included. The lever can be attached at a point near the intersection of the handle and the outer lid wall. The attachment is preferably a single point or line such that the lever can be rotated. When not in use, the lever can lay unobtrusively between the two bars. To use the lever, it is rotated about 180° around the point or line of attachment.

After the outer lid is detached, the inner lid is removed. A grasping means on the inner lid facilitates removal of the inner lid from the mouth of the inner container. Moreover, a grasping means decreases the chances of one coming in contact with the hazardous material contents during the process of removing the inner lid. A suitable grasping means for the inner lid is a finger tab 10 as shown in FIGS. 1 and 4. Generally, the finger tab is attached to the inner lid at a location closer to the wall than the center but far enough from the wall for the average worker's finger to fit between the tab and the wall. The minimum distance to the wall should be about 0.5–0.75 inches. The tab must be large enough for the average worker to firmly grasp it between two fingers.

In order to provide a sufficiently large tab, the tab height from the point of attachment to the point farthest from the inner lid (the tip) is frequently greater than the height of the inner lid wall. Such tabs bend and/or revolve around the point of attachment as the outer lid is fastened to the outer container and pushes against the protruding tab. Preferrably, the finger tab 10 is formed such that it curves or angles from the point of attachment towards the center of the inner lid as shown in FIG. 4. This orientation renders the tab easier to grasp and avoids tab interference with the outer lid-inner lid lip contact. More preferably, at least the undersurface of tab 10 is textured, with ridges 20 for example, to enable a firm grasp of the tab.

The inner container is designed for safe and complete removal of the hazardous material contents. There are no shoulders, rims or other areas of limited access. The inner diameter of the inner container mouth is as large and preferably larger than the inner diameter elsewhere in the inner container. The corner where the base meets the wall is rounded as shown in FIG. 1 and the inner surface of the inner container is smooth. Using a tool, such as a scoop, spoon, knife or spatula, made of inert material, one can readily remove the hazardous contents, particularly thick film paste, without coming closer than the length of the tool to the contents. Most importantly, one need not stick one's hand into the inner container to reach material lodged in a region of the inner container that is difficult to access.

To maximize available storage space, containers holding unused portions are often stacked on top of each other. A stacking means may be incorporated into the container to enable the containers to be stacked safely and stably. A preferred stacking means 14 is depicted in FIG. 4. An impression large enough to accommodate the bottom of outer container 1 is formed in the top of outer lid 11. The impression has walls which prevent the upper container whose bottom is in the impression from sliding off the lid of the lower container.

Even the larger containers which have a handle in the outer lid can include the preferred stacking means. In FIG. 8, the outer wall of lid 11C is taller than handle 18. Stacking means 14C comprises a ledge and a wall. The ledge is the same or a shorter distance from the top of the lid 11C outer wall as the top of handle 18. The bottom of a container stacked on lid 11C rests on the ledge. The wall which basically is that section of the outer wall between the ledge and the top of the outer wall prevents a container stacked thereon from sliding off lid 11C.

From the foregoing description of the preferred stacking means, it is clear that the O.D. of the outer lid must be greater than the O.D. of the bottom of the outer container that is stacked on it. Preferably, the O.D. of the outer lid is about the same as the O.D. of the outer container and the O.D. of the bottom of each outer container is smaller than the outer lid O.D. The wall of the outer container curves toward the center of the container to meet the smaller diameter bottom. The total height of the curved section is about 0.125–1.0 inch. If necessary, the wall of stacking means 14 can be curved with at least the same angle of curvature as the outer container to accommodate the outer container.

It is to be understood that the forms of the invention shown and described herein are but preferred embodiments and that various changes may be made without departing from the spirit and scope of the invention.

We claim:

1. A container for a thick film paste composition or component thereof comprising:

(a) an outer container comprising a clarified polymeric jar which includes lid fastening means on the neck of the jar for fastening an outer lid over the mouth of the polymeric jar and retention means in the mouth of the jar for holding an inner container in place within the outer container;

(b) an inner container comprising a polymeric cup which is inert to thick film paste compositions and components thereof, said cup including securing means defining a lip on the outside wall which cooperate with retention means in the mouth of the outer container to irremovably maintain the two containers in a substantially fixed position relative to each other;

(c) an inner lid having a lip which inner lid is inert to thick film paste compositions and components thereof and is dimensioned for removable friction fit within the mouth of the inner container such that the lip of the inner lid substantially covers the lip of the inner container, the lid including a sealing ring on the lip thereof, and a grasping means to remove the inner lid from the mouth of the inner container without contacting the contents of the inner container; and (d) an outer lid for the outer container, inner container, inner lid assembly comprising jar fastening means which engage the lid fastening means on the neck of the outer container to removably fasten the outer lid, the outer lid including contact means so that when fully fastened to the outer container contacts the inner lid, pressing the sealing ring on the inner lid lip against the lip of the inner container thereby compression sealing the assembly.

2. The container of claim 1 wherein the retention means on the outer container comprises a rim along the circumference of and projecting into the mouth of the outer container and the securing means on the outer wall of the inner container comprises the lip of the inner container and a locking rib, both the lip and rib protruding from the outer surface of the inner container and forming a recess into which the rim irremovably fits.

3. The container of claim 2 wherein the lid fastening means and jar fastening means comprise buttress threads.

4. The container of claim 3 wherein the outer container comprises a material selected from the group consisting of clarified polypropylene.

5. The container of claim 4 wherein the inner container and inner lid comprise a material independently selected from the group consisting of high density polyethylene and surface fluorinated high density polyethylene.

6. The container of claim 5 wherein the grasping means of the inner lid comprises a finger tab.

7. The container of claim 6 further comprising gripping means on the outside surface of the outer container.

8. The container of claim 7 wherein the gripping means on the outer container comprises a roughened surface.

9. The container of claim 7 wherein the gripping means on the outer container further comprises a U-shaped indentation in the side of the outer container, the parallel legs of the U-shaped indentation being perpendicular to the direction of rotation of the buttress threads, spaced about 2–5 inches apart and the walls of the indentations being angled from the outer container surface towards each other.

10. The container of claim 7 wherein the gripping means on the outer container further comprises a section of reduced diameter, the reduced diameter being interrupted by at least two protrusions, the protrusions being perpendicular to the direction of rotation of the buttress threads and spaced 2–5 inches apart.

11. The container of claim 7 further comprising gripping means on the outer lid comprising grooves on the outer periphery of the outer lid, the grooves being perpendicular to the direction of rotation of the buttress threads.

12. The container of claim 11 wherein the outer lid includes a pressure ring which projects from the central section of the outer lid towards the inner lid and contacts the inner lid during elevated pressure conditions.

13. A system of packaging thick film paste comprising a plurality of containers of claim 1, the inner container of each container having a different maximum capacity.

14. The system of claim 13 wherein the outer containers are the same size.

15. The system of claim 13 wherein each container of the system further comprises a label area on the outer wall of the outer container, the label area on all containers being at least the same size as the label area on the smallest outer container.

16. The system of claim 15 wherein the label area on each container is positioned at the same distance from the bottom of each container.

17. A container comprising:

(a) an outer container comprising a clarified polymeric jar which includes buttress screw threads on the neck of the jar for fastening an outer lid over the mouth of the polymeric jar and a rim along the circumference of and projecting into the mouth of the jar;

(b) an inner container comprising a polymeric cup which is irremovably inserted into the polymeric jar, said cup including a lip and a plurality of locking ribs, both the lip and ribs protruding from the outer surface of the inner container and forming a recess into which the rim of the outer container irremovably fits to maintain the two containers in a substantially fixed position relative to each other;

(c) an inner lid including a lip dimensioned for removable friction fit within the mouth of the inner container such that the lip of the inner lid substantially covers the lip of the inner container, the lid including a sealing ring on the lip thereof, and a grasping means to remove the inner lid from the mouth of the inner container without contacting the contents of the inner container; and (d) an outer lid for the outer container, inner container, inner lid assembly comprising buttress screw threads which engage the buttress screw threads on the neck of the outer container to removably fasten the outer lid, the outer lid including contact means so that when fully fastened to the outer container the outer lid contacts the inner lid, pressing the sealing ring on the inner lid lip against the lip of the inner container thereby compression sealing the assembly.

18. The container of claim 17 wherein the grasping means of the inner lid comprises a finger tab.

19. The container of claim 17 further comprising gripping means on the outside surface of the outer container.

20. The container of claim 19 wherein the gripping means on the outer container comprises a roughened surface.

21. The container of claim 19 wherein the gripping means on the outer container further comprises a U-shaped indentation in the side of the outer container, the legs of the U-shaped indentation being perpendicular to the direction of rotation of the buttress threads, spaced about 2–5 inches apart and the walls of the indentations being angled from the outer container surface towards each other.

22. The container of claim 19 wherein the gripping means on the outer container comprises a section of reduced diameter, the reduced diameter being interrupted by at least two protrusions, the protrusions being perpendicular to the direction of rotation of the buttress threads and spaced 2–5 inches apart.

23. The container of claim 17 further comprising gripping means on the outer lid comprising grooves on the outer periphery of the outer lid, the grooves being perpendicular to the direction of rotation of the buttress threads.

24. The container of claim 17 wherein the outer lid includes a pressure ring which projects from the central section of the outer lid towards the inner lid and contacts the inner lid during elevated pressure conditions.

* * * * *